US005803562A

United States Patent [19]

Jacobs et al.

[11] Patent Number: 5,803,562

[45] Date of Patent: Sep. 8, 1998

[54] SELF-CONTAINED PORTABLE OFFICE

[75] Inventors: Ronna L. Jacobs, Saugatuck; Allen B. Belka, Wayland; Bruce J. Cutean; Barry L. Andersen, both of Holland, all of Mich.

[73] Assignee: Haworth, Inc., Holland, Mich.

[21] Appl. No.: 598,202

[22] Filed: Feb. 7, 1996

[51] Int. Cl.[6] ..... A47B 81/00

[52] U.S. Cl. ..... 312/283; 312/290; 312/235.3; 312/223.3; 312/315

[58] Field of Search ..... 312/283, 290, 312/249.8, 249.9, 249.11, 235.3, 239, 223.3, 313, 314, 316, 194, 235.2, 315; 190/11; 434/432; 108/130, 131, 132, 48

[56] References Cited

U.S. PATENT DOCUMENTS

| | | | |
|---|---|---|---|
| Re. 17,720 | 7/1930 | Wheary . | |
| D. 45,866 | 6/1914 | Farlow . | |
| D. 180,094 | 4/1957 | Miller . | |
| D. 215,453 | 10/1969 | Menne . | |
| D. 254,043 | 1/1980 | Genaro et al. . | |
| D. 281,382 | 11/1985 | Byrne et al. . | |
| D. 284,242 | 6/1986 | Sackett et al. . | |
| D. 289,715 | 5/1987 | Kirch . | |
| D. 330,124 | 10/1992 | Short . | |
| D. 334,483 | 4/1993 | Johnson . | |
| D. 356,220 | 3/1995 | Belisle . | |
| D. 357,599 | 4/1995 | Kelley . | |
| D. 357,781 | 4/1995 | Crinion . | |
| D. 364,756 | 12/1995 | Felber . | |
| D. 370,797 | 6/1996 | Miller . | |
| D. 388,637 | 1/1998 | Kelley et al. . | |
| 1,480,080 | 1/1924 | Kent . | |
| 1,632,268 | 6/1927 | Berry | 312/314 X |
| 1,994,044 | 3/1935 | Michelet . | |
| 2,478,563 | 8/1949 | Book . | |
| 2,614,017 | 10/1952 | Mugnier . | |
| 2,614,018 | 10/1952 | Engel . | |
| 2,665,963 | 1/1954 | Wallack . | |
| 2,672,921 | 3/1954 | Herrick . | |
| 2,692,812 | 10/1954 | Stahl . | |
| 2,697,018 | 12/1954 | Georgides | 108/131 X |
| 2,755,156 | 7/1956 | Nichols . | |
| 2,808,305 | 10/1957 | Jackson . | |
| 2,963,332 | 12/1960 | Breuning . | |
| 3,592,520 | 7/1971 | Marino . | |
| 3,878,939 | 4/1975 | Wilcox . | |
| 4,236,460 | 12/1980 | Poupko . | |
| 4,478,467 | 10/1984 | Tyndall . | |
| 4,709,971 | 12/1987 | Leeds et al. . | |
| 4,736,998 | 4/1988 | Wilson et al. . | |
| 4,919,498 | 4/1990 | Turner . | |
| 4,993,782 | 2/1991 | Williams . | |
| 5,129,491 | 7/1992 | Seidman . | |
| 5,429,432 | 7/1995 | Johnson . | |
| 5,584,548 | 12/1996 | Miller | 312/235.3 |

OTHER PUBLICATIONS

The Wall Street Journal, Workers on the Go Get a Mobile Work Space, Feb. 3, 1995, 2 pages.

Newspaper article—Box Office, Feb. 10, 1995, 1 page.

*Primary Examiner*—Peter M. Cuomo

*Assistant Examiner*—Janet M. Wilkens

*Attorney, Agent, or Firm*—Flynn, Thiel, Boutell & Tanis, P.C.

[57] ABSTRACT

A portable and transportable workstation having a cabinet having opposed side walls joined to an upright rear wall extending therebetween, the cabinet defining an interior compartment accessible through an open upright front side, and a door connected by a hinge along a front edge of the cabinet for horizontal swinging movement of the door between open and closed positions. A stationary table top is disposed within the interior compartment to define a stationary work surface and a telescoping table top is disposed adjacent the stationary table top so as to define a main work surface. on the side wall opposite the door, an upper side wall portion is hinged to a lower side wall portion and is foldable downwardly to a horizontal position to define an auxiliary work surface. The top end of the cabinet includes a hinged cover and the bottom end includes a removable panel to accommodate a user. Additionally, a storage space is provided between the front edges of the stationary and telescoping table tops when the door is in a closed position so as to accommodate a backrest of a chair, the lower portion of which stores within the cabinet below the stationary and telescoping table tops.

22 Claims, 14 Drawing Sheets

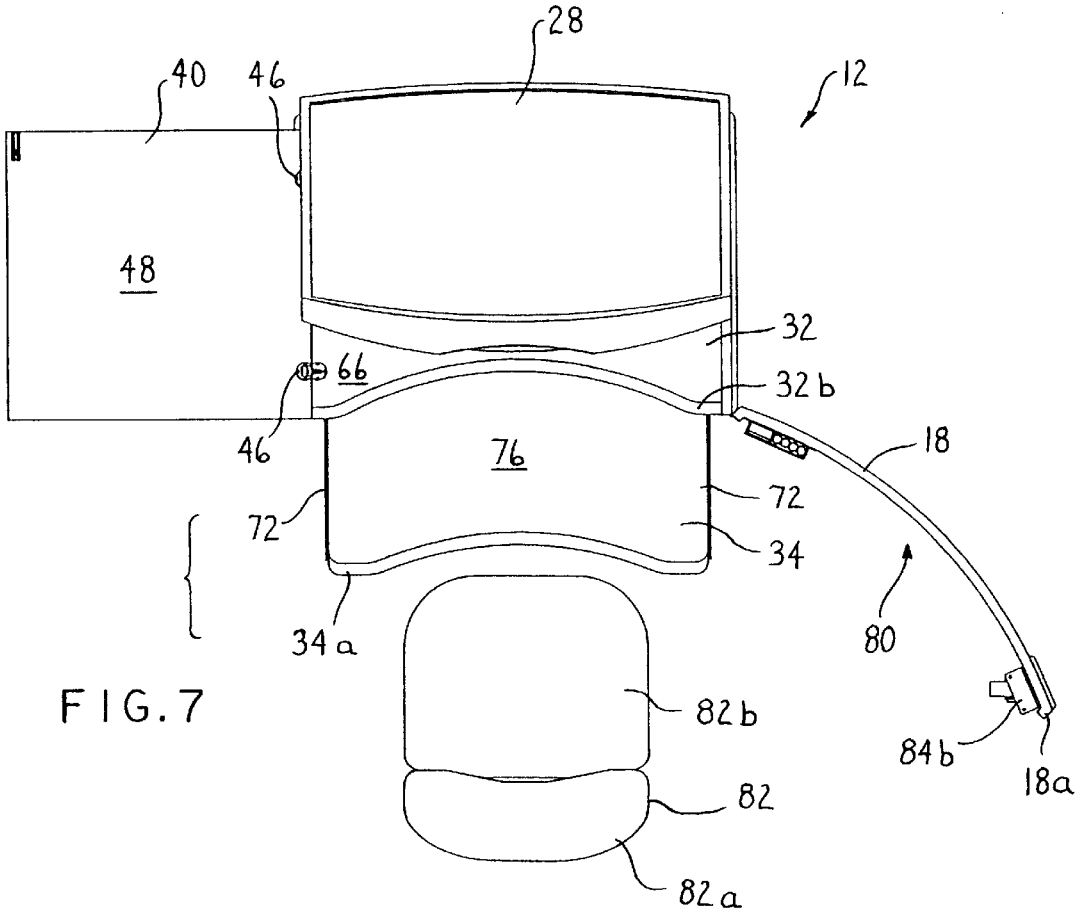
FIG. 7
FIG. 8
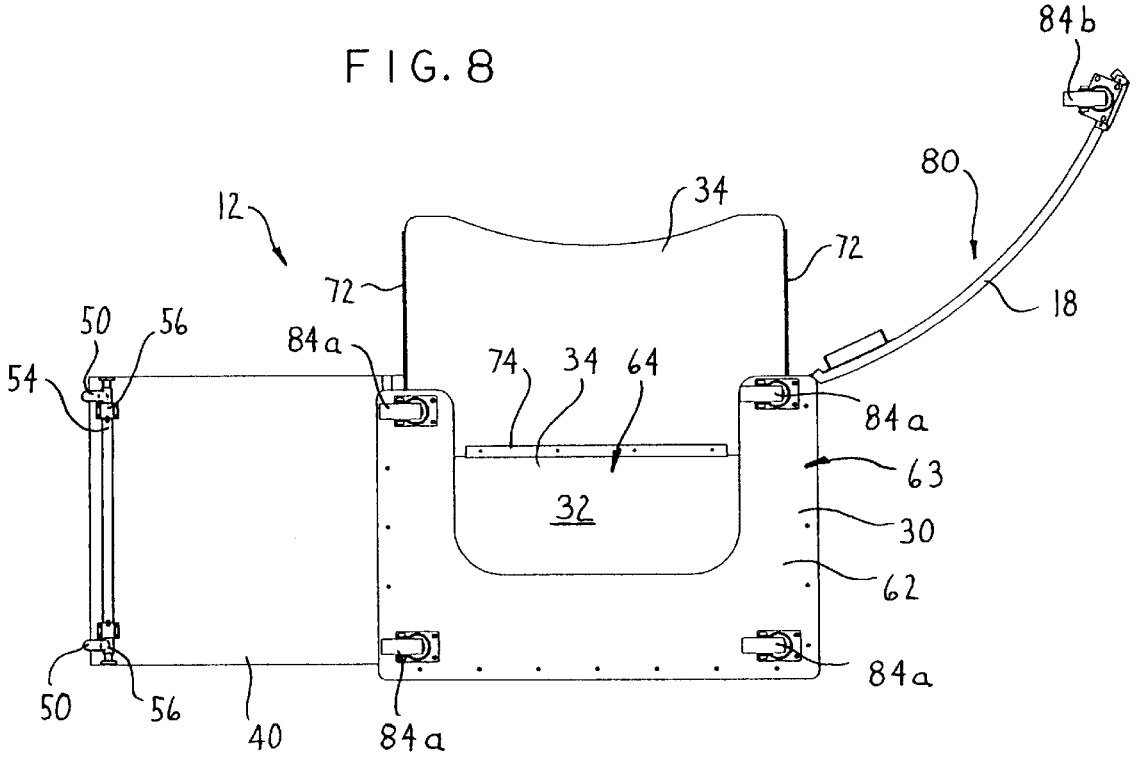

SELF-CONTAINED PORTABLE OFFICE

FIELD OF THE INVENTION

This invention relates to a self-contained portable workstation or office and, more specifically, to an improved portable workstation which includes and is storable within a transportable trunklike enclosure having openable covers and doors which can be stably supported and function as part of the workstation when in an open position.

BACKGROUND OF THE INVENTION

The typical office environment is centralized in a large office space which is divided into the necessary number of offices by fixed walls or wall panel systems. However, with the increasing use of computers, modems, facsimile machines, cellular communications and other technological advances, businesses are more mobile and flexible as they expand their markets regionally, nationally or internationally. With this increase in mobility and flexibility comes an attendant increase in the amount of work being done outside of the centralized office location and instead done for example, in hotels while travelling, in home offices or in small offices associated with a larger main office. Accordingly, a need exists for portable workstations which can be readily stored when not in use but which can be opened into a reasonably equipped workstation.

This increased demand by businesses for mobility and flexibility in conducting business and particularly the capability of providing a reasonably equipped small office or workstation which can be easily set up or taken down, and safely and easily transported, is a need which is not fulfilled by office furniture products of the type currently available. In particular, most conventional office furniture products are not sufficiently portable or sufficiently compact, and are not easily and compactly storable so as to facilitate quick set up and take down.

While various portable and/or knock down furniture components have been developed, including various collections of components which attempt to function as a portable office and are storable within an enclosure, nevertheless past developments in this respect for the most part have not been commercially accepted on any significant scale. While the exact reasons for same is not known, nevertheless it is believed that prior attempts at providing a portable office have been deficient with respect to the overall collection and arrangement of products and functions provided by the portable office, and more significantly a lack of easy transportability and durability, and an inability to maximize the number of structures and functions which can be accommodated within and provided by the portable office.

The present invention relates to an improved self-contained portable workstation which is storable within a transportable enclosure, which enclosure when opened functions as part of the workstation in terms of supporting office equipment and at the same time permitting other office fixtures forming part of or stored in the enclosure to be opened outwardly or extended from the opened enclosure to define an officelike workstation. In this improved transportable workstation, the enclosure in particular incorporates an openable door and a foldable side wall which function as part of the open workstation.

More particularly, in a preferred embodiment, the portable workstation or office of this invention includes a trunklike enclosure having an upright main storage cabinet. This cabinet is of a boxlike construction that is open on one vertical face as well as at a top end thereof. The cabinet is provided with a closeable main door hinged along one vertical edge thereof, and a closeable top cover or cap disposed on the top end of the cabinet. In addition, a portion of at least one side wall is foldable outwardly and downwardly away from the cabinet interior and is supported horizontally by a support member for use as a side work surface. Within the interior of the cabinet, a stationary work surface is supported therein and a retractable work surface is located adjacent the stationary work surface to provide an extendible or telescoping work area when in the open condition which is releasably lockable thereat. By providing front edges of the stationary and telescoping work surfaces with inwardly curving edges and providing the door with an outwardly curving shape, a space is provided therebetween to accommodate the backrest of a chair, the lower portion of which chair can be accommodated in a storage space disposed within the cabinet below the work surfaces. The storage space below the work surfaces can also accommodate a separate removable table in addition to the chair. Due to the flexibility of the inventive workstation, an additional cabinet sized to fit below the table may be provided, for example, instead of the chair. The enclosure also mounts therein other desirable office fixtures such as additional shelves, a marker and/or tack board, storage containers, and the like. The overall enclosure including specifically the main boxlike cabinet is of minimal structural complexity and size to minimize weight and optimize the interior storage compartments. Still further, a bottom wall includes a central opening to accommodate the legs of a user and may be provided with a trapdoor-like cover panel or plate which is closeable over the central opening to fully enclose the bottom of the cabinet. The bottom wall also projects sidewardly beyond the cabinet walls so as to act as a protective bumper during transport.

With this arrangement, both aesthetic and functional requirements for the workstation are accommodated. In particular, whether the inventive workstation is in the open or closed condition, the workstation is such that the workstation blends aesthetically with the furniture of the home, hotel or office where the workstation is located.

Other objects and purposes of the invention will be apparent to persons familiar with structures of this general type upon reading the following specification and inspecting the accompanying drawings.

BRIEF DESCRIPTION OF THE DRAWINGS

FIG. 7 is a top plan view of the open workstation illustrating a chair positioned for use in the workstation area.

FIG. 8 is a bottom view of the open workstation.

Figure 1:
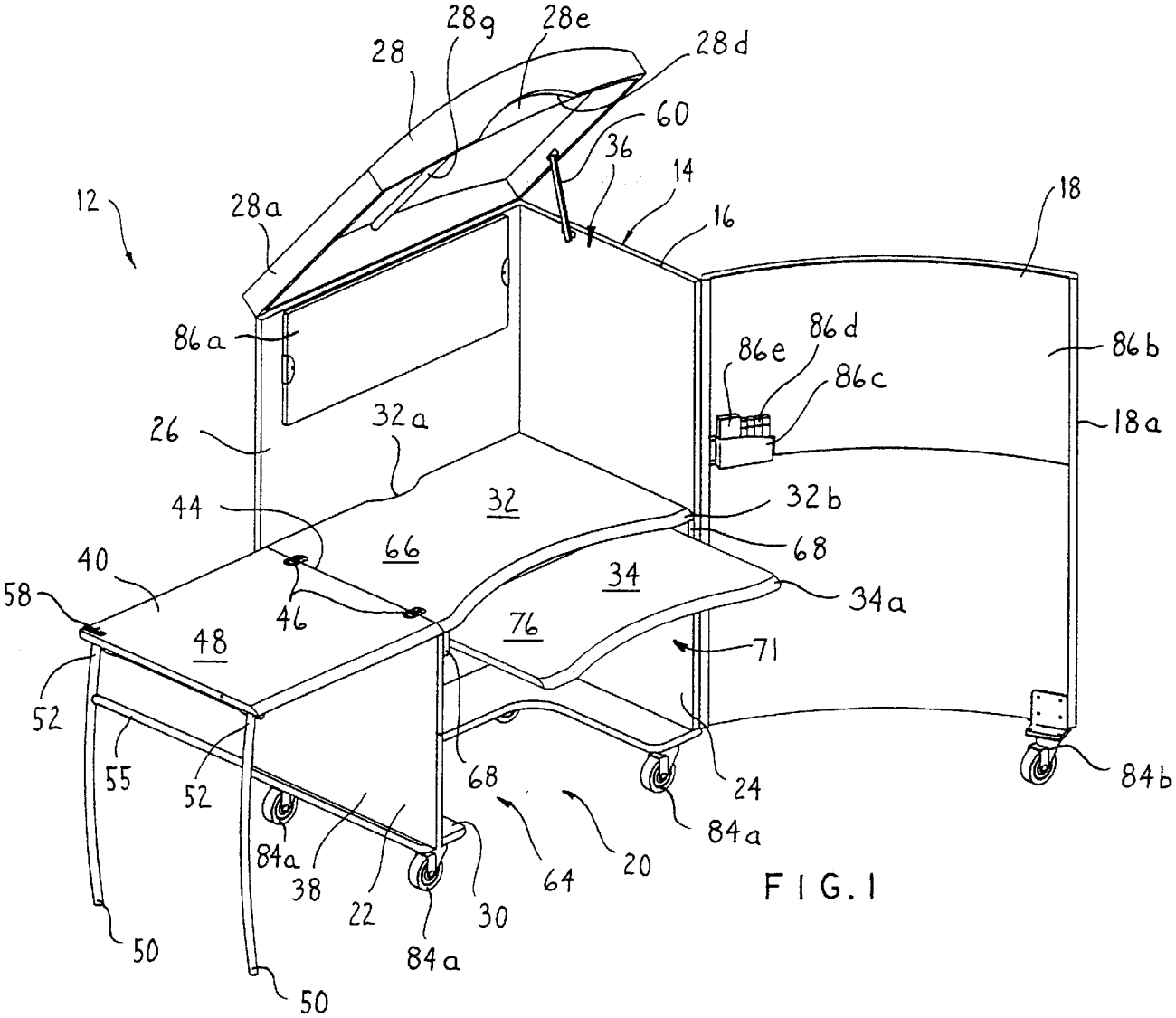
FIG. 1 is a perspective view showing a preferred embodiment of a transportable office-type workstation of the present invention shown in an open condition.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
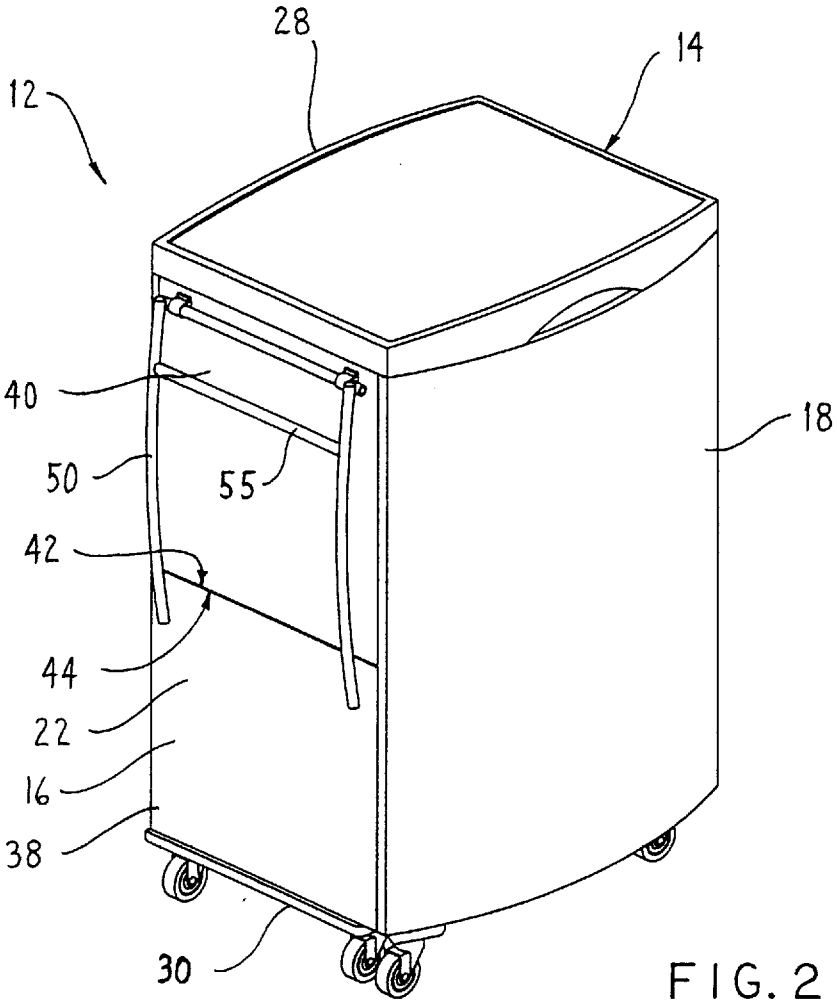
FIG. 2 is a perspective view showing the workstation of FIG. 1 in a closed condition.

Referring to the drawings and specifically FIGS. 1 and 2, a self-contained portable workstation or office 12 is illustrated according to the present invention. FIG. 1 illustrates the portable workstation 12 in an open condition for use as an office, and FIG. 2 illustrates the transportable workstation 12 in the closed transportable condition. It will be appreciated that the open workstation illustrated in FIG. 1 is devoid of necessary working equipment such as a computer, lighting or other office equipment and fixtures, such additional elements being eliminated from the drawing for clarity of illustration.

The portable workstation 12 includes an enlarged trunk-like enclosure or housing 14 defined primarily by an upright cabinet 16 having an openable door 18 associated with an open upright front side or opening 20 thereof.

The upright cabinet 16 includes generally parallel and vertically extending side walls 22 and 24 which are rigidly and substantially perpendicularly joined to a generally vertically enlarged rear wall 26. The cabinet 16 also includes an openable top cover 28 and a horizontal bottom wall or floor 30 extending laterally a predetermined distance from the side walls 22 and 24 and forwardly from the rear wall 26. A stationary table top 32 as well as a retractable table top 34 are located within an interior compartment 36 of the cabinet 16.

More particularly, the left side wall 22 includes a lower side wall portion or panel 38 and a foldable upper side wall portion or panel 40. The lower side panel 38 is rigidly secured along a back edge thereof to the rear wall 26 and is rigidly secured along a lower edge thereof to the bottom wall 30. The lower side panel 38 extends vertically upwards approximately one-half the total height of the left side wall 22 and terminates at an upper edge 42.

The upper side panel 40 has a lower edge 44 which is pivotally connected to the stationary table top 32 proximate the upper edge 42 of the lower side panel 38 by hinges 46 or the like. The hinges 46 define a horizontal hinge axis which permits the upper side panel 40 to pivot outwardly from a closed position illustrated in FIG. 2 which is vertically aligned with the lower panel 38, to the substantially horizontal open position illustrated in FIG. 1 which is oriented substantially normal to the vertical plane of the lower side wall panel 38. When pivoted to the horizontal open position (FIG. 1), the upper side panel 40 defines an upward facing auxiliary or side work surface 48 which is accessible by a user (not illustrated) due to the side opening created after the downward pivoting of the upper side panel 40.

Figure 3:
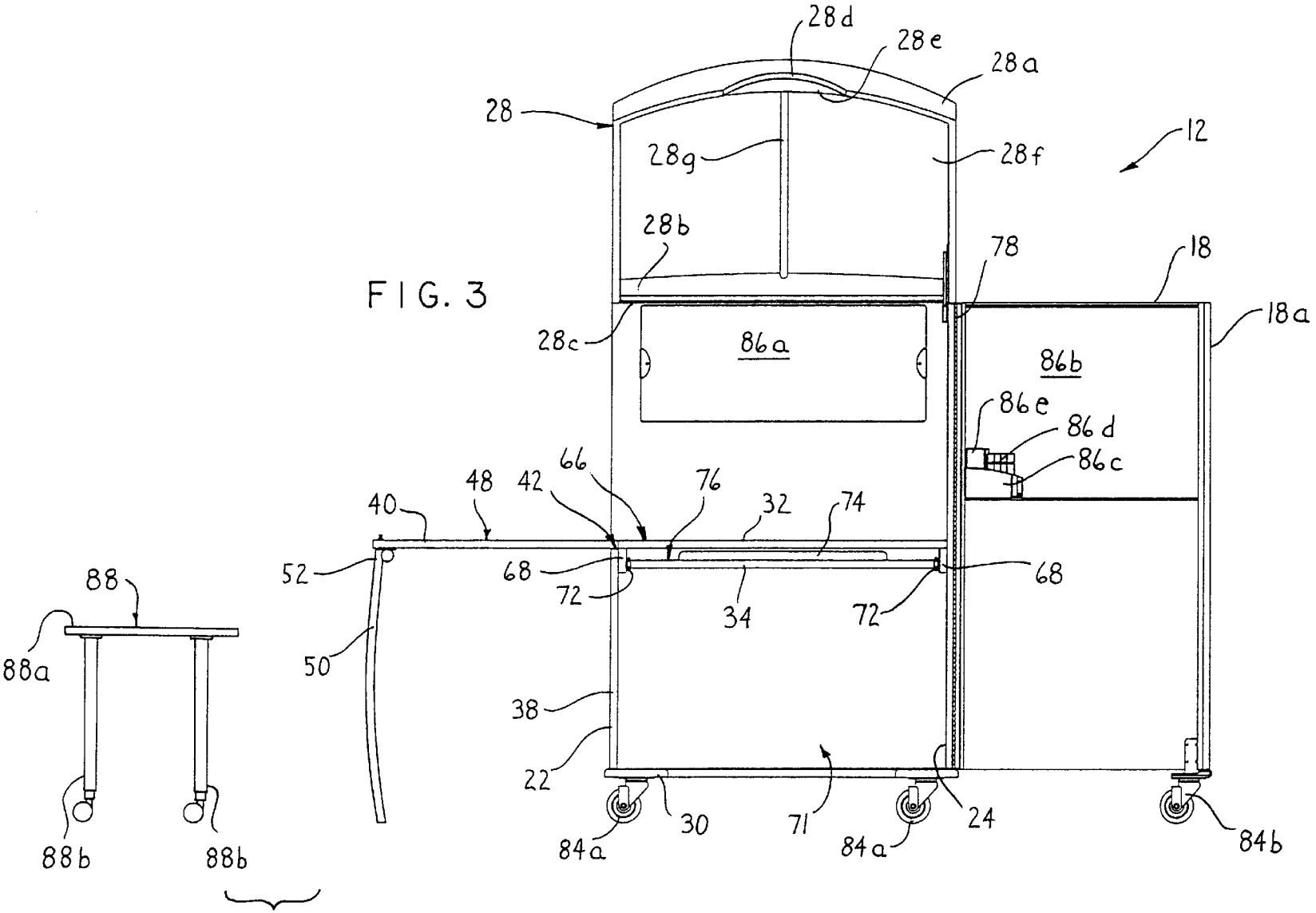
FIG. 3 is a front elevational view of the open workstation of FIG. 1.
Figure 5:
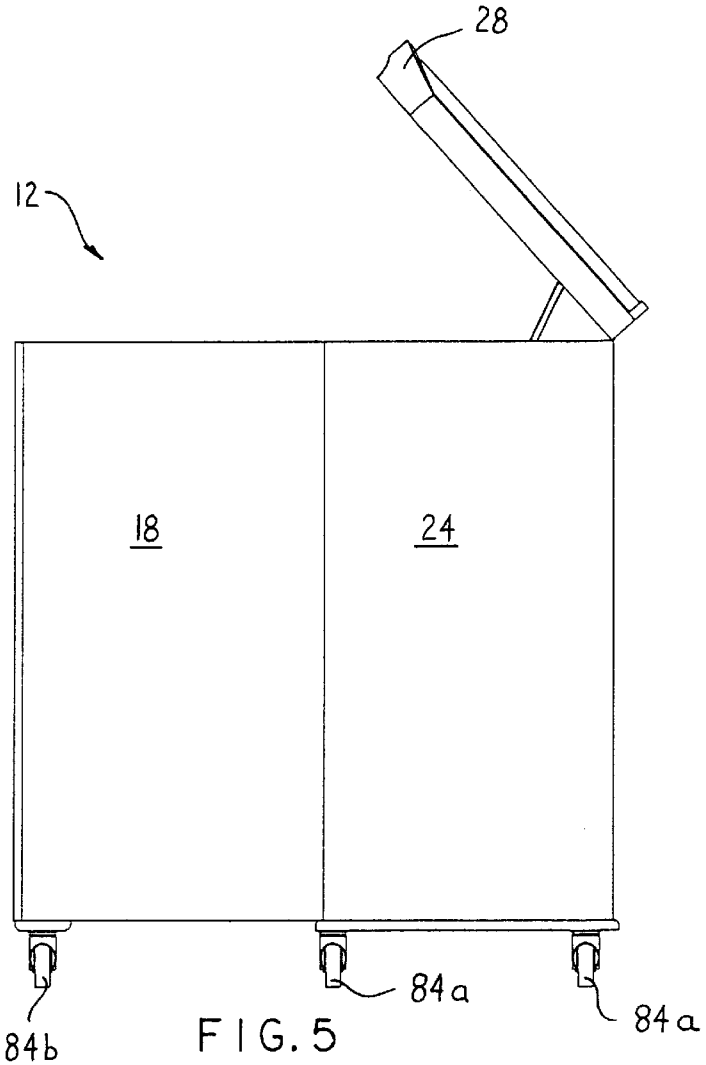
FIG. 5 is a right-side elevational view of the open workstation.

Preferably, the hinges 46 are of a known hinge construction which are manufactured by Hafele America Co., Archdale, N.C. and designated as part No. 342.66.101. With these hinges 46, the side work surface 48 is oriented flush with respect to the stationary table top 32 when positioned in the horizontal open position (FIG. 3). When closed, however, the upper panel 40 is drawn toward the lower panel 38 by the action of the hinges 46 to minimize any gap formed between the opposing lower edge 44 and the upper edge 42 (FIG. 2).

Figure 4:
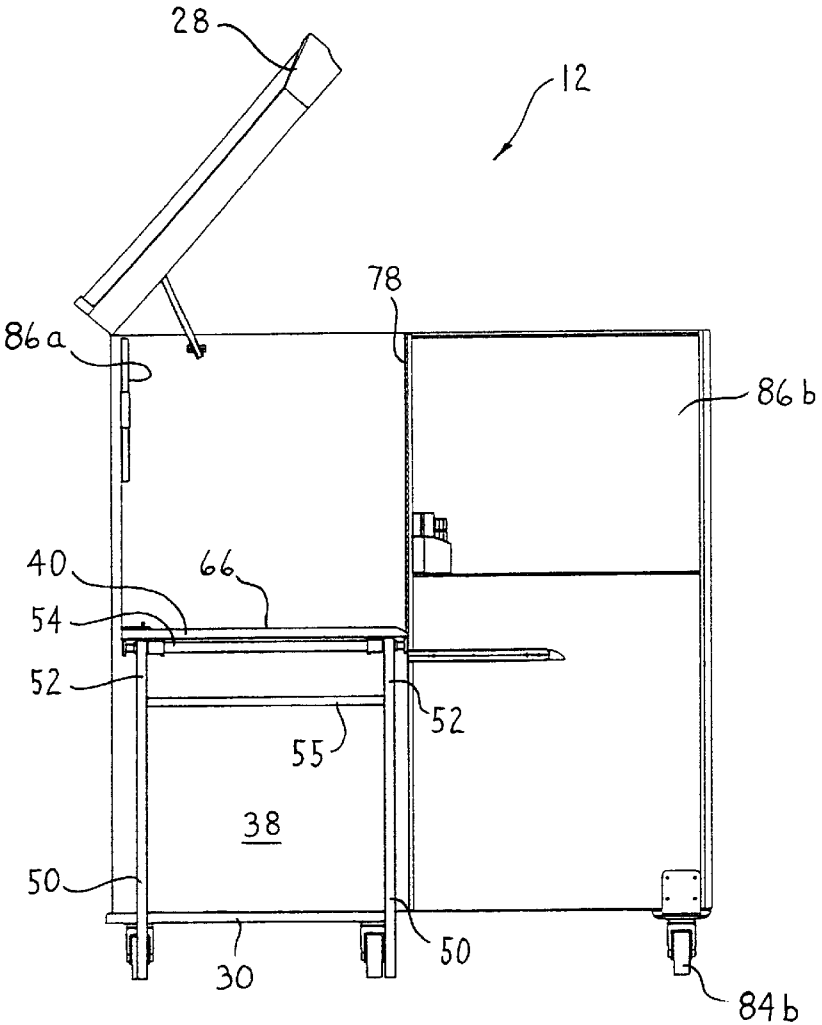
FIG. 4 is a left-side elevational view of the open workstation.
Figures 11A, 11B, 11C:
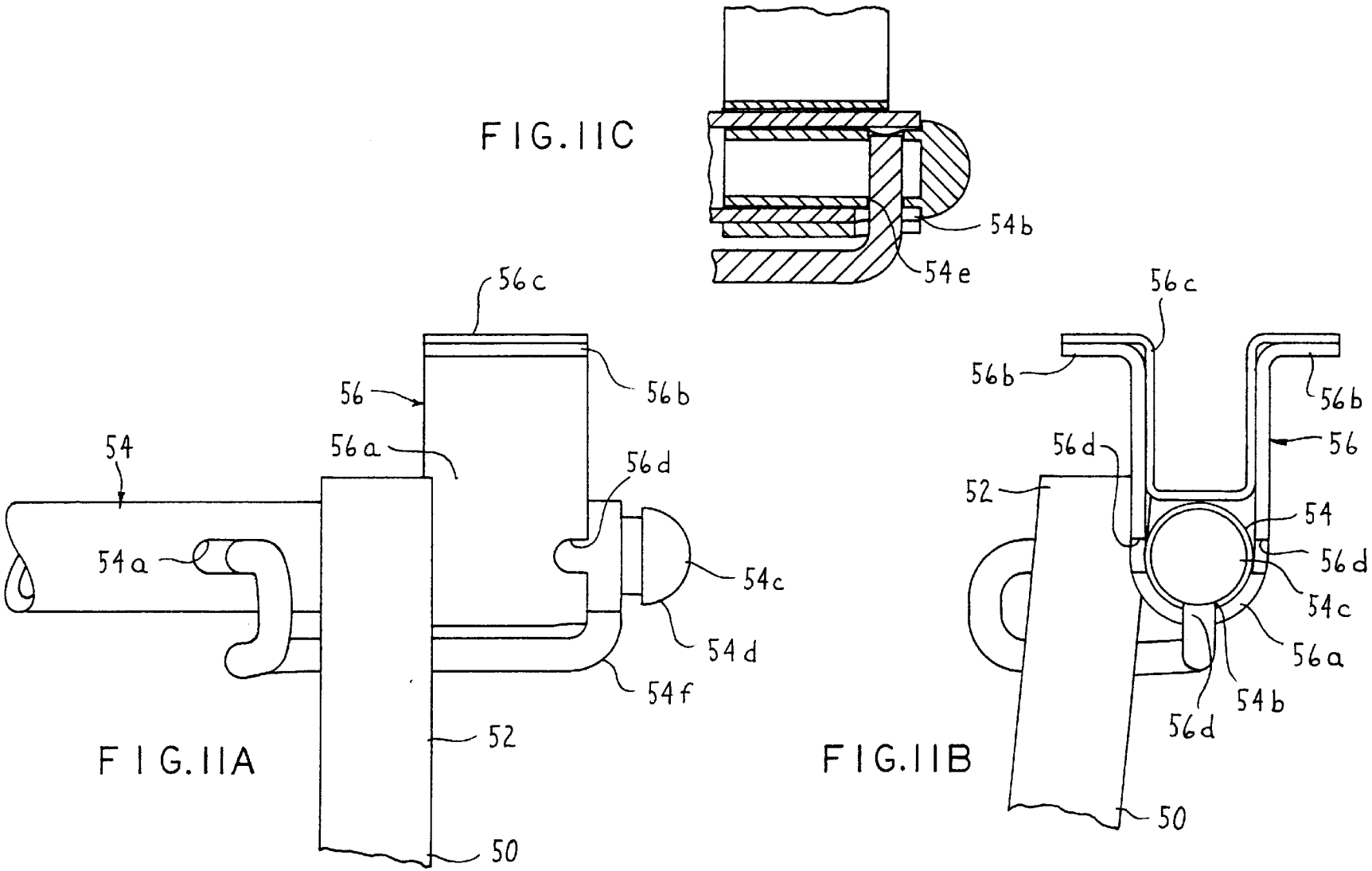
FIG. 11A is a partial left side elevational view illustrating portion of a support leg in the downwardly depending support position of FIG. 1.
FIG. 11B is a partial front elevational view of the portion the support leg of FIG. 11A.
FIG. 11C is a partial cross sectional view of the support leg of FIG. 11A.
Figure 12:
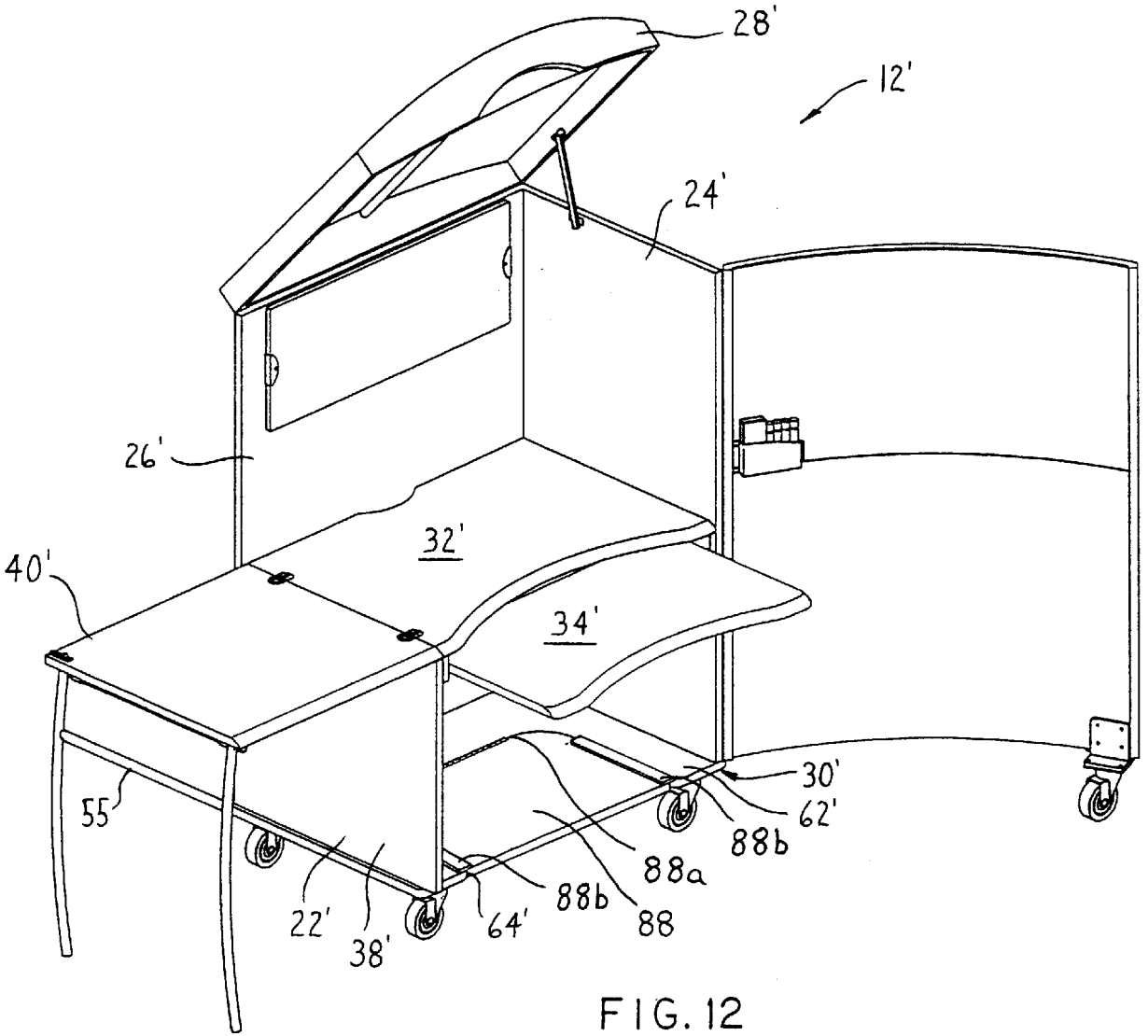
FIG. 12 is a perspective view illustrating a second embodiment of the workstation of FIG. 1 which includes a bottom cover plate depicted in a closed position.

To support the upper side panel 40 in the open position, a pair of support legs 50 are pivotally mounted to the upper side panel 40 as shown in FIGS. 3 and 4. The support legs 50 preferably are arcuate tubular members each having an upper end 52 fixedly secured to a cross member 54 in a parallel spaced apart relation. To strengthen the leg structure, a second cross member 55 is also provided which is fixedly secured to and spans the legs 50. Referring to FIGS. 4, 11A and 11B, the cross member 54 is rotatably mounted on the exterior of the upper side panel 40 by a pair of generally U-shaped mounting brackets 56 fastened to the upper panel 40. The brackets 56 retain the opposite ends of the cross member 54 in position on the cabinet 16 so as to permit pivoting of the support legs 50 from a downwardly hanging closed position adjacent the upper side panel 40 (FIG. 2) to an open support position depending downwardly from the upper side panel 40 (FIG. 1). The support legs 50 have a sufficient length so as to contact a base surface (i.e. a floor) on which the workstation 12 is placed when in the open position. When in the closed position, the support legs 50 are useable as handles to facilitate movement of the workstation 12. Further, the side wall 22 includes saddle-like retainers (not illustrated) which receive the tip ends of the legs 50 to hold the legs 50 in the closed position while acting as bumpers to prevent marring of the side wall 22 due to contact with the tip ends.

Referring to FIG. 11A, 11B and 11C, each mounting bracket 56 has a semi-circular portion 56*a*, which rotatably receives the respective end of the cross member 54 therein, and flange portions 56*b* at the ends of the bracket 56 which flange portions 56*b* are secured to the upper side panel 40 by any suitable fastening means such as screws or the like. To retain the cross member 54 within the semi-circular portion 56*b*, a cooperating U-shaped clip 56*c* is inserted in the open space between the flange portions 56*b* and abuts against the cross member 54. In the illustrated embodiment, the semi-circular portion 56*b* also includes outwardly opening notches 56*d* spaced at 90 degree intervals for locking of the support legs 50 in the open or closed position. While only two notches 56*d* are necessary for said locking, three are provided so that the same bracket 56 can be used at either end of the cross member 54.

To facilitate said locking in the illustrated embodiment, the cross member 54 includes an elongate channel 54*a* on one side of the respective support leg 50, an outwardly opening notch 54*b* and a pluglike insert 54*c* inserted into the open end of the cross member 54 which is being rotatably supported by the bracket 56. The insert 54*c* includes a head 54*d*, which limits insertion of the insert 54*c* into the cross member 54, and a bore 54*e* extending through the insert 54*c*. To lock the support leg 50 in position, a rod 54*f* is provided with one end disposed within the bore 54*e* and an opposite end inserted into the elongate channel 54*a*. The rod 54*f* is shaped so as to permit limited lateral movement of the insert 54*c* within the cross member 54 such that a portion of the rod end, which extends out of the bore 54*e*, seats within a corresponding notch 56*e* and notch 54*b* when aligned in registry to prevent rotation of the support legs 50. To permit pivoting of the support legs 50, the insert 54*c* is moved a limited distance out of the cross member 54 so that the seated portion of the rod end moves out of the notch 56*d* and the notch 54*b* so as to permit said pivoting.

In the preferred embodiment of the leg actuating mechanism (not illustrated), the bracket 56' includes a notch 56*d*' in the semi-circular portion 56*b*. This notch 56*d*' is releasably engaged by a spring-biased plunger which is slidably received within the cross member 54 and has a radially projecting rod which seats within the notch 56*d*' to lock the leg 50 in the open position. To lock the legs 50 in the closed position, the saddle-like retainers (not illustrated) each have a releasable engagement button for engaging the tip ends of the legs 50.

To retain the upper panel 40 in the closed position (FIG. 2), a sliding bolt or other locking mechanism 58 (FIG. 1) is mounted on a distal end of the upper panel 40. The locking mechanism 58 is manually actuatable to engage the rear wall 26 so as to lockingly retain the upper panel 40 in the closed position until such time as the locking mechanism 58 is released.

Figure 6:
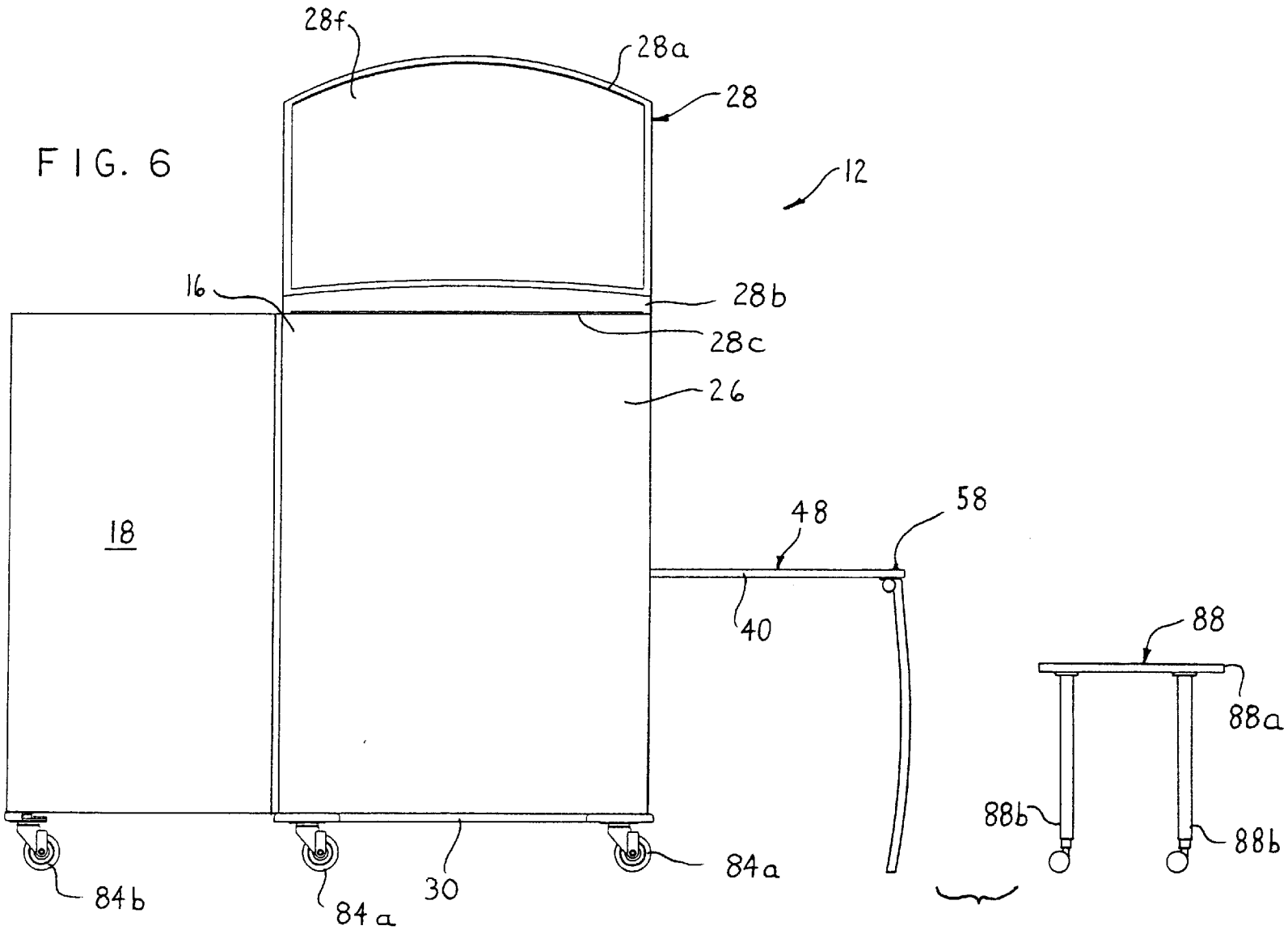
FIG. 6 is a back-side view of the open workstation.
Figure 9:
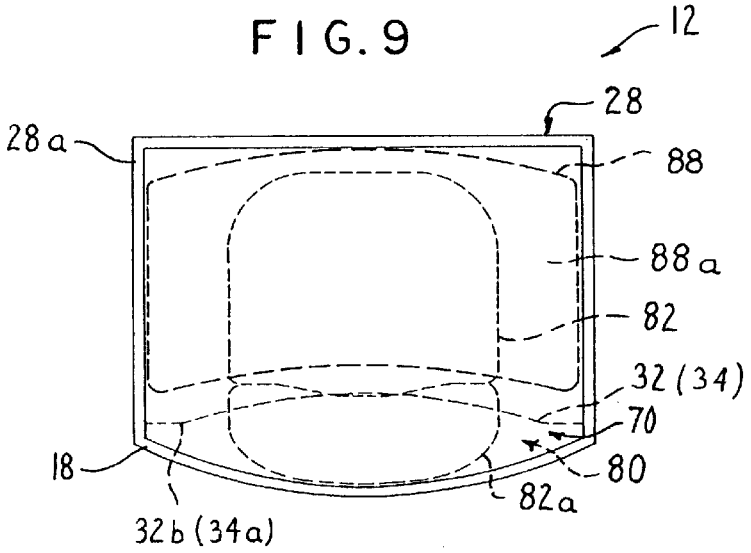
FIG. 9 is a top plan view of the workstation in the closed condition of FIG. 2 illustrating the chair and a freestanding table in phantom outline disposed in a stored position within the workstation.

Referring to FIGS. 3 and 6, the cabinet 16 also includes the top cover 28 at an open upper end thereof. The top cover 28 has a rectangular peripheral edge wall 28*a* oriented coplanar with the periphery of the cabinet 16 as shown in FIG. 9, the rear side 28*b* of which is hinged to the upper end of the rear wall 26. Preferably, the top cover 28 is hingedly connected to the rear wall 24 by a hinge 28*c* (FIGS. 3 and 6) or the like which extends substantially along the length of the rear side 28*b* and defines a horizontal hinge axis. The hinge 28*c* permits the top cover 28 to be moved from the closed position (FIG. 2), which encloses the top end of the interior compartment 36, to the open position illustrated in FIG. 1. To facilitate ventilation of the interior compartment 36 when the workstation 12 is closed, an arcuate ventilation notch 28*d* is formed in the front of the peripheral edge wall 28*a*, which preferably includes a perforated metal screen 28*e*. By providing the ventilation notch 28*d*, heat generated by a computer (not illustrated) or other office equipment, which is stored within the housing 14 and which is still warm or has been left on after the workstation 12 is closed, may accordingly be dissipated.

Referring to FIGS. 3 and 6, the top cover 28 also includes an arcuately shaped upward facing top panel 28*f* secured to the peripheral edge wall 28*a* and a rearwardly extending support brace 28*g* below the top panel 28*f* to support and strengthen the top panel 28*f*. While opening of the top cover 28 facilitates the entry of light into the interior compartment 36, the top panel 28*f* preferably is formed of a translucent material which further facilitates the entry of light into the interior compartment 36 while at the same time providing the desired privacy and security when the top cover 28 is in the closed position (FIG. 2).

To maintain the top cover 28 in the open position (FIG. 1), a lockable telescoping support brace 60 is attached by opposite ends thereof to the cabinet 16 and to the peripheral edge wall 28*a*. The support brace 60 preferably is extendable and is lockable when extended to provide the necessary support. Such support braces 60 preferably are of a conventional construction with which the skilled artisan is familiar and thus a specific description is not necessary for an appreciation of the inventive workstation 12 described herein.

Referring to FIGS. 1 and 8, the bottom wall 30 is a one-piece construction which comprises a U-shaped peripheral edge wall 62. The peripheral edge wall 62 is secured to the left and right side walls 22 and 24 and the rear wall 26 by fasteners or adhesives (not illustrated) and opens forwardly to define a central opening or interior passage 64. The central opening 64 serves to accommodate the legs of a user who typically will be seated in a direction facing toward and into the interior compartment 36.

Referring to FIGS. 1 and 3, the stationary table top 32 is securely mounted so as to extend horizontally across the interior compartment 36 and, more particularly, is securely connected to the left and right side walls 22 and 24 and the rear wall 26 so as to define an upward facing stationary work surface 66. To support the stationary table top 32, a pair of elongate rectangular support rails 68 are mounted to the interior surfaces of the respective left and right side walls 22 and 24 to define shoulders extending into the interior compartment 36 upon which the stationary table top 32 is supported and fastened. The side rails 68 preferably are located so that the stationary work surface 66 is aligned flush with the auxiliary work surface 48, and are chamfered at the front end so as to have a downward facing bevel (not illustrated) which slopes downwardly and rearwardly away from the front end face.

The table top 32 is located proximate the upper edge 42 of the lower side panel 38. Preferably, the table top 32 is oriented substantially horizontal and aligned coplanar with the side work surface 48 although the specific orientation of the table top 32 may vary. To facilitate the connection of electrical and/or telecommunication components which may be supported on the stationary table top 32, a notch or channel 32*a* extends therethrough, preferably adjacent the rear wall 26. The notch 32*a* is dimensioned so as to accommodate electrical and communication cabling extending therethrough which may be run downwardly through open areas of the bottom wall 30 discussed below for temporary connection to main electrical or telecommunication cabling of the building. To provide a storage space 70 between the stationary table top 32 and the door 18 when the door 18 is in the closed position (FIG. 9), a front edge 32*b* of the table 32 preferably has an arcuate concave shape curving rearwardly into the interior of the cabinet 16.

To provide additional work surface space for the user, the retractable table top 34 is mounted a short distance below the stationary table top 32 and defines the storage space 71 between the bottom surface of the retractable table top 34 and the opposing upper surface of the bottom wall 30.

More particularly, the retractable table top 34 is a horizontally-enlarged platelike member that is slidably mounted below the stationary table top 32 by slide rails 72 (FIGS. 3 and 7) which are fixedly secured to the support rails 68 and permit the retractable table top 34 to telescope between a stored retracted position illustrated in FIG. 9 wherein top 34 is parallel with and spaced a small distance directly below top 32, and an extended use position as illustrated in FIGS. 1 and 4 wherein top 34 projects forwardly a substantially distance beyond the front of top 32. Preferably the retractable table top 34 has a front edge 34*a* having the same arcuate concave shape as the stationary table top 32. To prevent objects from passing through the vertical gap disposed between the stationary table top 32 and the retractable table top 34, a barrier rail 74 extends laterally across at least a portion of the rear edge of the retractable table top 34 and is secured thereto by fasteners.

With this arrangement, the stationary table top 32 can accommodate computers or other equipment stored within the cabinet 16 during transport while the retractable table top 34 can be readily telescoped outwardly to the use position to provide a ready to use upward facing work surface 76 which can be used either for writing or other similar uses, such as to accommodate a keyboard of a computer being stored in the interior compartment 36.

The front side or opening 20 of the cabinet 16 is adapted to be closed by the door 18 which is connected to the cabinet 16 by a vertically elongate hinge 78 that defines a vertically extending hinge axis disposed adjacent the front edge of the right side wall 24, whereby the door 18 can be horizontally hingedly swung between the open and closed positions illustrated respectively by FIGS. 1 and 2. The side edge 18*a* of the door 18 remote from the hinge 78 preferably has a conventional latch (not shown) which cooperates with the mutually adjacent left side wall 22 of the cabinet 16 when in the closed position so as to hold the door 18 closed, such latch being typically activated in a conventional manner, such as by a key-activated lock or the like.

Figure 10:
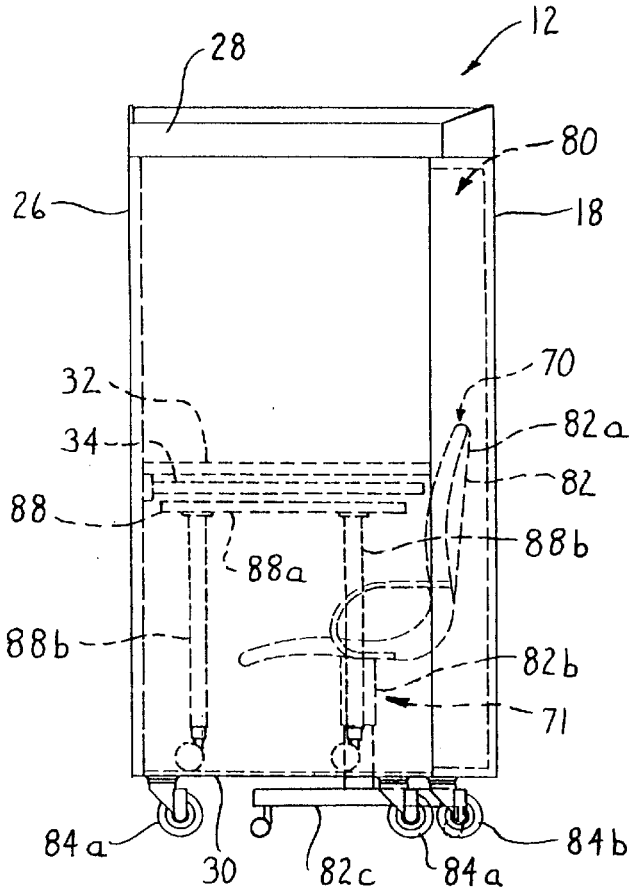
FIG. 10 is a left-side elevational view illustrating the closed workstation of FIG. 9.

To further increase the space between the door 18 and the front edges 32*b* and 34*a* respectively of the stationary table top 32 and the retractable table top 34, the door 18 is provided with an outwardly protruding arcuate (i.e. convex) shape so as to generally define a cavity 80 extending between the opposite vertical side edges of the door 18. Referring to FIGS. 9 and 10, the cavity 80 in combination with the space provided by the arcuate concave shape of the front edges 32*b* and 34*a* serve to define the storage space 70 therebetween which, for example, accommodates a chair 82 and, in particular, the backrest 82*a* of the chair 82 illustrated in phantom outline in FIG. 9. Thus, during storage or transport, the chair 82 can be stored within the interior compartment 36 and readily removed for use. More particularly, the lower portion 82*b* of the chair 82 is readily accommodated within the storage space 71 defined between the retractable table top 34 and the bottom wall 30. When stored, the leg structure 82*c* of the chair 82 extends through the central opening 64 of the bottom wall 30. The skilled artisan will appreciate that other geometric shapes and structural arrangements of the door 18 and the front edges 32*b* and 34*a* of the table tops 32 and 34 can be readily used to accommodate different sized or shaped chairs 82 or other office equipment accommodated therein.

To facilitate the transport of the workstation 12 a plurality of casters 84*a*, preferably four, are mounted to the bottom of the bottom wall 30 at each corner thereof. Further, to minimize the structure and weight of the cabinet 16 in order to maximize the interior storage space and at the same time minimize the overall weight, a downwardly depending door caster 84*b* is mounted to the distal or free end of the door 18 so as to vertically support the door 18 during opening and closing thereof while at the same time increasing the stability of the cabinet 16 as a whole when in the open condition. This caster 84*b* is adapted to be positioned in contact with the support surface or floor while at the same time preventing load-bearing induced distortion of the door 18 and cabinet 16 which may otherwise interfere with proper utilization of the workstation and specifically of the components associated therewith.

With the above-described arrangement, a plurality of work surfaces 48, 66 and 76 are provided to accommodate not only office equipment but also other desirable office fixtures 86 such as a tack board 86*a* which in the preferred embodiment is mounted on the rear wall 26, and a marker board 86*b* mounted on the door 18. In combination with the marker board 86*b*, a storage container 86*c* adapted to store markers 86*d* and an eraser 86*e* is provided. The skilled artisan will readily appreciate from the disclosure herein that other fixtures or equipment may be mounted within the workstation 12 depending upon the requirements of the particular workstation 12 being formed thereby.

Referring to FIGS. 9 and 10, where desired, an additional freestanding table 88 may be provided in combination with the workstation 12, and storable in the storage space 71 disposed below the table tops 32 and 34. The table surface 88*a* is dimensioned so as to fit between the chair armrest 82*d* and the retractable table top 34. The table legs 88*b* preferably are extendible to vary the height of the table surface 88*a* during use although they also may have a fixed length. Still further, a freestanding file cabinet (not illustrated) may be stored below the additional freestanding table 88 within the space 71 below the table tops 32 and 34.

When preparing the portable workstation 12 of this invention for transport, the retractable table top 34 is pushed inwardly into the interior compartment 36 and the upper side wall panel 40 is pivoted upwardly and locked in the vertical closed position by the locking mechanism 58. When positioning the upper side panel 40 in this closed position, the support legs 50 readily rotate about the cross member 54 to the downwardly hanging position illustrated in FIG. 2. At the same time, the top cover 28 is manipulated to release the lockable support brace 60 and permit the top cover 28 to be positioned in the closed position. The additional freestanding table then is inserted into the storage space 71 disposed below the table tops 32 and 34. Also, the freestanding file cabinet (not illustrated) or the lower seat portion 82*b* is stored below the additional freestanding table while in the case of the chair 82, the backrest 82*b* is received within the space 70 defined by the front table edges 32*b* and 34*a*. Once all of the workstation fixtures and equipment are stored within the interior compartment 36, the door 18 is horizontally pivoted to the closed position and locked thereat for transportation. Due to the casters 84, the workstation 12 can be readily transported, positioned for use and then reopened to the open condition illustrated in FIG. 1 for temporary office use. With this arrangement a portable workstation 12 can be readily set up and taken down without the necessity of additional tools or disassembly and reassembly of component fixtures and parts to construct the workstation 12. Rather, the workstation 12 is set up and taken down by mere manipulation of the components described herein.

Figure 13:
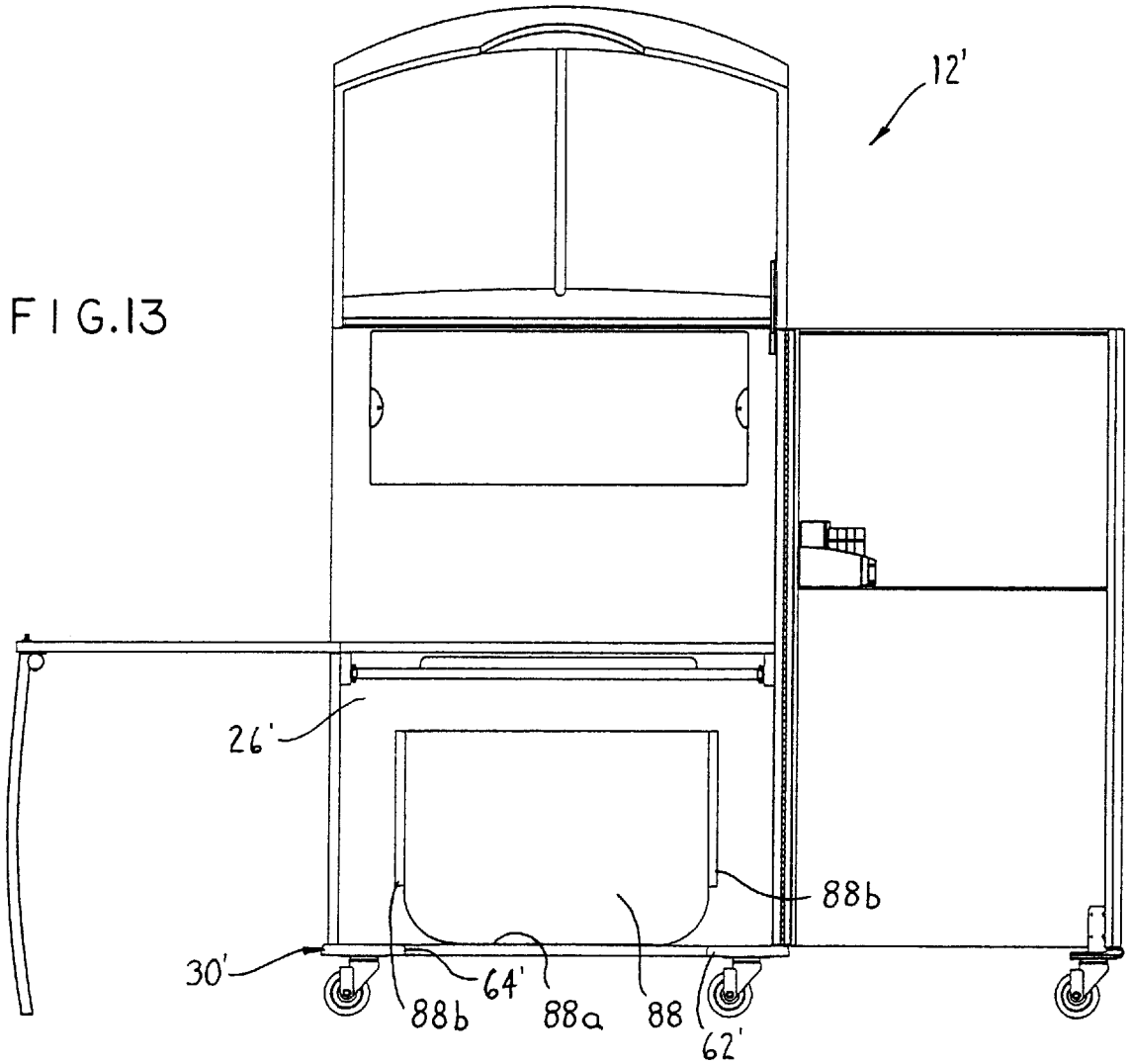
FIG. 13 is a front elevational view of the open workstation of FIG. 12 with the bottom cover plate in an open position.
Figure 14:
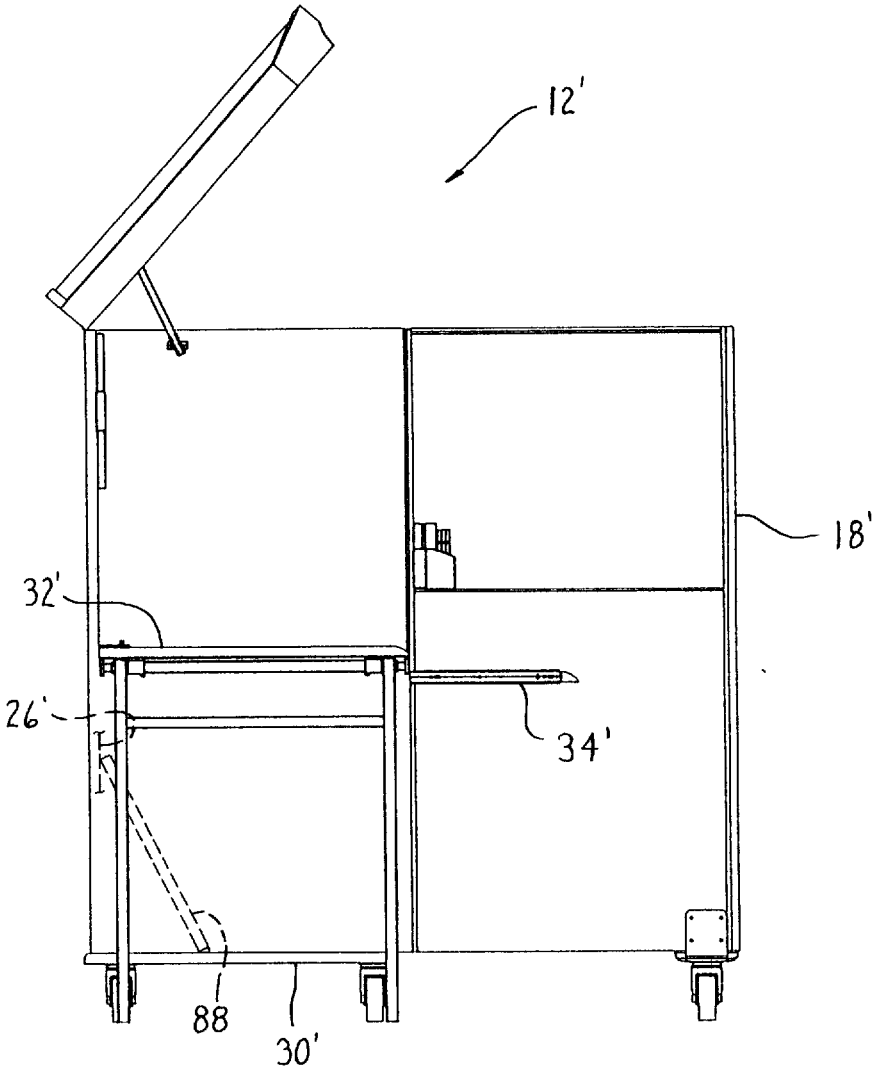
FIG. 14 is a left side elevational view of the second embodiment of FIG. 13.

A second embodiment 12' is disclosed in FIGS. 12–15 with corresponding parts designated by the same reference numerals previously described herein with the addition of primes (') thereto which second embodiment is substantially the same as the workstation 12 described herein except that the bottom wall 30' is of a two piece construction. The bottom wall 30' comprises a U-shaped peripheral edge wall 62' and a trapdoor-like bottom cover or cover 88. To enclose the central opening 64' typically for transport, the bottom cover 88 has a rear edge 88*a* hingedly connected to a mutually adjacent edge of the peripheral edge wall 62' so that the bottom cover 88 is movable from a horizontal closed position (FIG. 12) enclosing the central opening 64' to an upwardly oriented open position (FIGS. 13 and 14). To support the bottom cover 88 in the horizontal closed position, the bottom cover 88 includes stepped sidewardly projecting flanges 88*b* which lie upon the peripheral edge wall 62' and maintain the bottom cover 88 and peripheral edge wall 62' substantially flush one with the other. Preferably, the flanges 88*b* are metal plates secured to the side edges of the bottom cover 88 by fasteners or the like.

Figure 15:
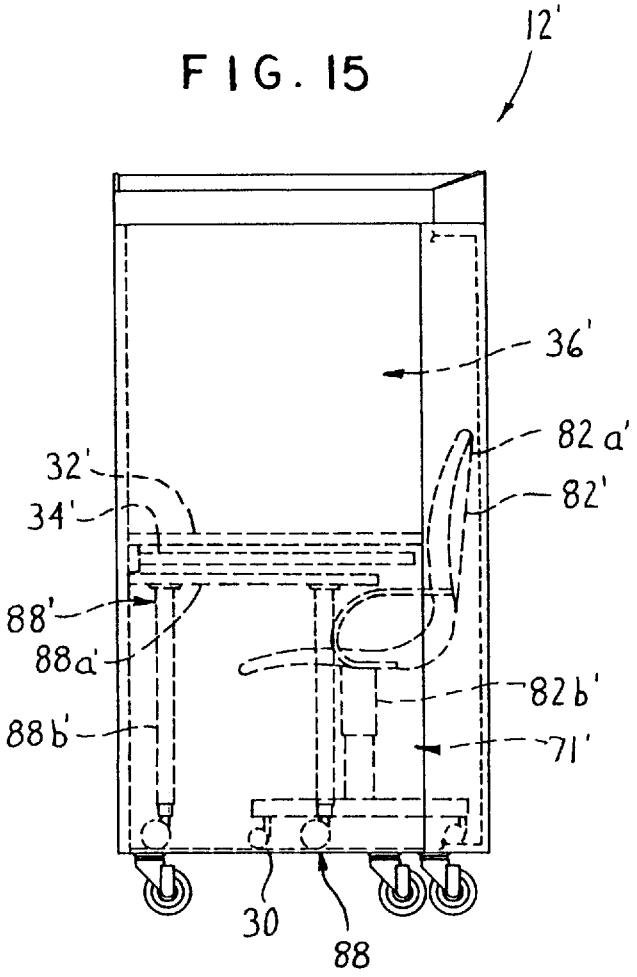
FIG. 15 is a left side elevational view of the workstation of FIG. 12 in the closed condition illustrating a chair and a freestanding table in phantom outline disposed in a stored position within the workstation.

Thus, during transport, the chair 82' can be stored within the interior compartment 36' as shown in FIG. 15, and readily removed for use. More particularly, the lower portion 82*b'* of the chair 82' is readily accommodated between the space 71' defined between the retractable table top 34' and the bottom wall 30' which bottom wall 30' supports the chair 82' when the bottom cover 88 is closed.

Alternatively, while the bottom cover 88 is illustrated as a single panel, the bottom cover 88 could be formed of two panel sections (not illustrated) hingedly connected together. Instead of angling toward the rear wall 26' when opened, one panel section lies horizontal against the peripheral edge 62' while the second section lies vertically upright against the rear wall 24' to thus provide more leg room. The second section can be releasably secured in the vertical position by a manually actuatable latch or the like.

Figure 16:
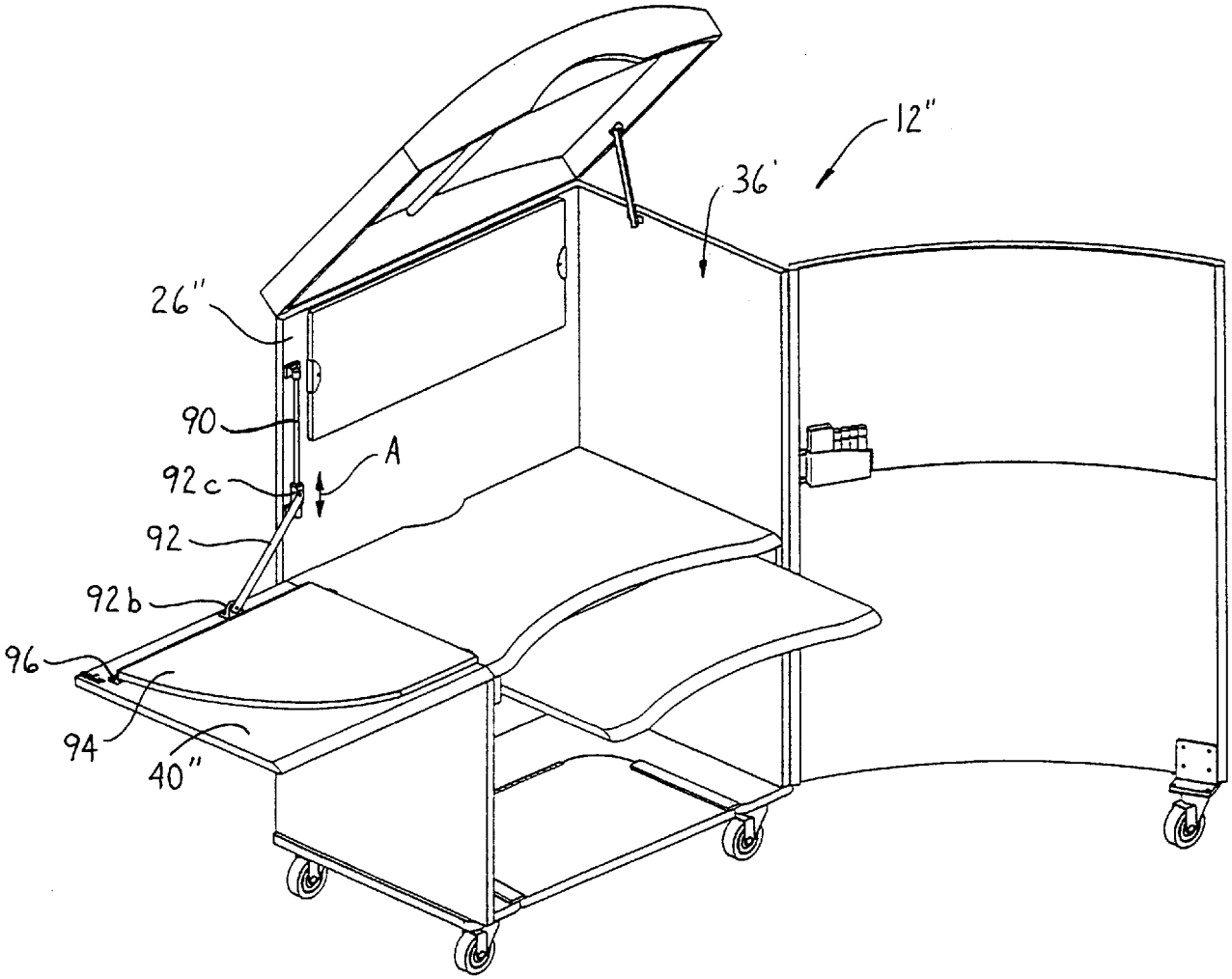
FIG. 16 is a perspective view illustrating a third embodiment of the workstation which includes a bottom cover plate depicted in a closed position, alternative support means for the side wall panel and a privacy screen in a stored position.
Figure 17:
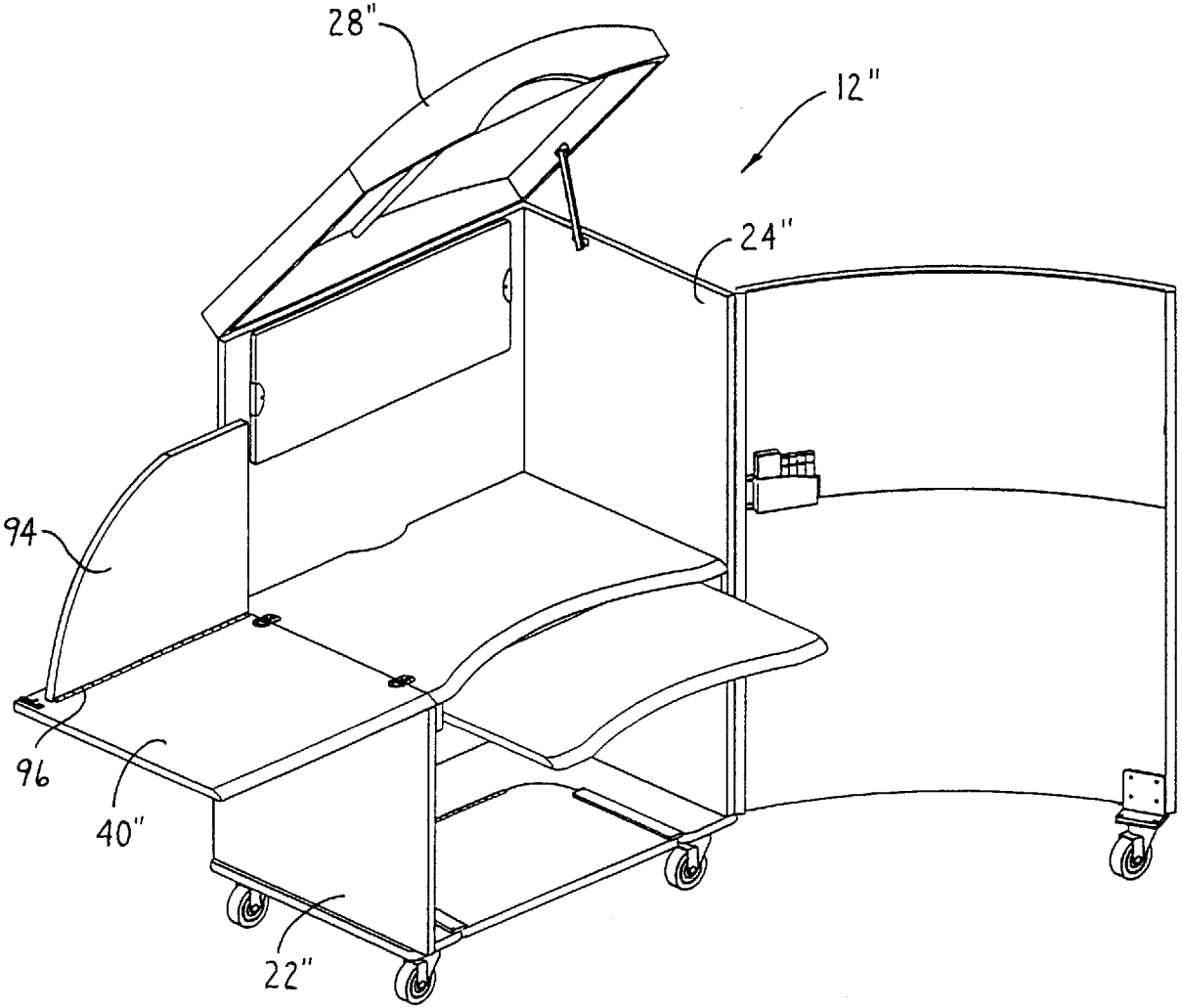
FIG. 17 is a perspective view of the workstation of FIG. 16 illustrating the privacy screen in an upstanding use position.

A third embodiment 12" is illustrated in FIGS. 16 and 17. In this embodiment, the above-described support legs 50 (not illustrated in FIGS. 16 and 17) are replaced with alternative support means for the upper panel 40".

In particular, the support means includes a vertical slide rod 90 which has opposite ends thereof mounted by brackets to the rear wall 26" and is spaced a predetermined distance forwardly from the rear wall 26". In addition, a support member 92 has a first end 92*a* pivotally connected to the inside surface of the upper side panel 40" and an opposite end 92*b* pivotally connected to a slide bearing 92*c* that is slidably mounted on the slide rod 90 so as to move vertically in the direction indicated by arrow A. When the upper side panel 40" is in the horizontal position illustrated in FIG. 16, the upper panel 40" is supported by the support member 92 and, in particular, is held in the horizontal position by the slide bearing 92*c* which is stopped in the lowermost position along the slide rod 90 so as to prevent additional rotating movement of the upper side panel 40". When folding the upper panel 40" to the closed vertical position, the slide bearing 92*c* slides vertically upwards along the slide rod 90.

Additionally, the third embodiment 12" includes a privacy screen 94 which is pivotally fixed to the upper panel 40" by an elongate hinge 96. The privacy screen 94 is movable from a folded position (FIG. 16) to a vertically upstanding use position (FIG. 17) when the upper panel 40" is supported in the horizontal position. The privacy screen 94 is folded downwardly (FIG. 16) to facilitate closing of the workstation 12".

Although particular embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A portable workstation, comprising:

an upright multi-sided hollow enclosure defined by a cabinet having opposed first and second side walls joined to an upright rear wall extending therebetween, said cabinet defining an interior compartment accessible through an open upright front side of said cabinet, and a door having opposite first and second side edges; said first side edge being hingedly connected to one front edge of said first side wall of said cabinet by hinge means for horizontal swinging movement of said door between open and closed positions, said door when in said closed position extending between said first and second side walls and having said second side edge disposed closely adjacent said second side wall so as to close off said open front side, said second side edge of said door being swingingly positioned outwardly away from said open front side of said cabinet when disposed in said open position; and a first table top disposed within said interior compartment which defines an upward facing first work surface, said side wall, said rear wall and said door extending upwardly a substantial distance above said first work surface;

said second side wall comprising a fixed first side wall portion joined to said upright rear wall, and a second side wall portion having pivot means disposed proximate a side edge of said first work surface for hingedly supporting said second side wall portion vertically above said first side wall portion for vertical swinging movement of said second side wall portion between open and closed positions, said second side wall portion being swingable outwardly into said open position wherein said second side wall portion extends horizontally sidewardly to define an upward facing second work surface, said second side wall including support means for releasably supporting said second side wall portion in said open position independent of said door, said second side wall portion when in said closed position being upwardly aligned with said first side wall portion.

2. The portable workstation according to claim 1, including a second table top disposed within said interior compartment below said first table top which defines a third upward facing work surface, said second table top being slidably supported in said cabinet by slide means to permit telescoping movement thereof between a storage position disposed within said interior compartment and a use position projecting outwardly away from said first table top when said door is in said open position, a lower edge of said second side wall portion being movable by said pivot means toward an upper edge of said first side wall portion so as to be disposed closely adjacent and vertically aligned with said upper edge when in said closed position, and toward said first table top so that said first and second work surfaces are oriented substantially flush one with respect to the other when in the open position.

3. The portable workstation according to claim 1, wherein said first table top has a front edge at least a portion of which is spaced inwardly away from a plane defined by said front edge of said first side wall and a front edge of said second side wall, said door having an interior surface which is spaced outwardly from said plane when said door is in said closed position to define a cavity which is in communication with said interior compartment when the door is in said closed position, an open storage space being defined between said front edge of said first table top and said interior surface of said door when said door is in said closed position.

4. The portable workstation according to claim 3, wherein said front edge of said first table top and said interior surface of said door are arcuately shaped so as to curve away one from the other to define said open storage space therebetween.

5. The portable workstation according to claim 1, wherein said support means comprise at least one downwardly depending support member pivotally supported by a pivot assembly connected to said second side wall portion, said support member disposed adjacent and overlying an exterior surface of said second side wall portion in a stored position when said second side wall portion is in said closed position, and said support member extending downwardly from said second side wall portion to a surface upon which the workstation is positioned when said second side wall portion is disposed in said open position, said pivot assembly including lock means for rigidly securing said support member in said stored position to define a handle which facilitates movement of said cabinet.

6. The portable workstation according to claim 1, wherein said support means comprise a support member connected to said second side wall portion and said rear wall when said second side wall portion is in said open position.

7. The portable workstation according to claim 1, wherein a top end of said interior compartment is enclosed by a top cover which is hingedly secured to said rear wall and is swingable from an open position to a closed position overlying said top end, said top cover including an elongate support member having a first end connected to said top cover and an opposite second end connected to said first side wall.

8. The portable workstation according to claim 1, wherein a bottom end of said cabinet includes a bottom wall disposed between said first and second side walls and extending forwardly away from said rear wall, said bottom wall including a U-shaped peripheral edge portion fixedly secured to said first and second side walls and said rear wall, said U-shaped peripheral edge portion defining a forwardly opening interior passage therethrough.

9. The portable workstation according to claim 8, wherein said bottom wall includes a bottom cover hingedly secured to said peripheral edge portion and movable between a closed position overlying said interior passage and an open position disposed upwardly out of said interior passage.

10. The portable workstation according to claim 1, wherein said door is hingedly connected to said first side wall above and below said first table top by said hinge means.

11. A portable workstation, comprising:

an upright multi-sided hollow enclosure defined by a cabinet having opposed first and second side walls joined to an upright rear wall extending therebetween, said cabinet defining an interior compartment accessible through an open upright front side of said cabinet, and door means hingedly connected to one front edge of said first side wall of said cabinet by hinge means for horizontal swinging movement of said door means between open and closed positions, said door means when in said closed position overlying said cabinet and closing off said open front side thereof, said door means being swingingly positioned outwardly away from said open front side of said cabinet when disposed in said open position;

a bottom wall disposed between said first and second side walls and extending forwardly from said rear wall;

a first table top disposed within said interior compartment which defines an upward facing first work surface;

a second table top disposed within said interior compartment which defines a second upward facing work surface, said second table top being slidably supported in said cabinet by slide means to permit telescoping movement thereof between a storage position disposed within said interior compartment and a use position projecting outwardly away from said first table top when said door means is in said open position;

a first storage space being defined within said interior compartment between said first and second table tops and said bottom wall; and said second side wall comprising a fixed first side wall portion having a rear edge region joined to said upright rear wall, and a second side wall portion having hinge means on a lower edge thereof for hingedly supporting said second side wall portion vertically above said first side wall portion for vertical swinging movement of said second side wall portion between open and closed positions, said second side wall portion when in said closed position extending upwardly from said first side wall portion, said second side wall portion being swingable outwardly into said open position wherein said second side wall portion extends sidewardly to define an upward facing third work surface oriented substantially flush with respect to said first work surface, said second side wall including non-linear support means comprising a non-linear support member for releasably supporting said second side wall portion in said open position independent of said door means, said lower edge of said second side wall portion being movable towards said upper edge of said first side wall portion so as to be disposed closely adjacent and vertically aligned with said upper edge when in said closed position and towards said first work surface such that said third work surface is substantially flush with respect to said first work surface when in said open position.

12. The portable workstation according to claim 11, wherein said support member depends downwardly and is pivotally supported by a pivot assembly connected to an exterior surface of said second side wall portion, said support member disposed adjacent said second side wall portion in a stored position when said second side wall portion is in said closed position, and said support member being disposed in a support position so as to extend downwardly from said second side wall portion to a base surface upon which the workstation is positioned when said second side wall portion is disposed in said open position, said support member being axially elongate and having a non-linear shape which projects outwardly away from said exterior surface when in said stored position such that a handle portion of said support member extends along but is spaced outwardly from said exterior surface to define a hand-receiving space, said cabinet including casters on a bottom thereof so as to be movable, said pivot assembly including releasable locking means for locking said support member either in said stored position or said support position such that forces applied to said handle portion when in said stored position by a user effect movement of said workstation.

13. A portable workstation, comprising:

an upright multi-sided hollow enclosure defined by a cabinet having opposed first and second side walls joined to an upright rear wall extending therebetween, said cabinet defining an interior compartment accessible through an open upright front side of said cabinet, and door means hingedly connected to one front edge of said first side wall of said cabinet by hinge means for horizontal swinging movement of said door means between open and closed positions, said door means when in said closed position overlying said cabinet and closing off said open front side thereof, said door means being swingingly positioned outwardly away from said open front side of said cabinet when disposed in said open position;

a bottom wall disposed between said first and second side walls and extending forwardly from said rear wall;

a first table top disposed within said interior compartment which defines an upward facing first work surface;

a second table top disposed within said interior compartment which defines a second upward facing work surface, said second table top being slidably supported in said cabinet by slide means to permit telescoping movement thereof between a storage position disposed within said interior compartment and a use position projecting outwardly away from said first table top when said door means is in said open position;

a first storage space being defined within said interior compartment between said first and second table tops and said bottom wall, said first table top having a front edge at least a portion of which is spaced inwardly away from a plane defined by said front edge of said first side wall and a front edge of said second side wall, a second open storage space being defined between said front edge of said first table top and an interior surface of said door and extending substantially across said first table top between said first and second side walls; and said second side wall comprising a fixed first side wall portion having a rear edge region joined to said upright rear wall, and a second side wall portion having hinge means on a lower edge thereof for hingedly supporting said second side wall portion vertically above said first side wall portion for vertical swinging movement of said second side wall portion between open and closed positions, said second side wall portion when in said closed position extending upwardly from said first side wall portion, said second side wall portion being swingable outwardly into said open position wherein said second side wall portion extends sidewardly to define an upward facing third work surface oriented substantially flush with respect to said first work surface, said second side wall including support means for releasably supporting said second side wall portion in said open position independent of said door means, said lower edge of said second side wall portion being movable towards said upper edge of said first side wall portion so as to be disposed closely adjacent and vertically aligned with said upper edge when in said closed position and towards said first work surface such that said third work surface is substantially flush with respect to said first work surface when in said open position.

14. The portable workstation according to claim 13, wherein said support means comprise a support member extending between said second side wall portion and said rear wall when said second side wall portion is in said open position.

15. The portable workstation according to claim 13, wherein said bottom wall includes a U-shaped peripheral edge portion fixedly secured to said first and second side walls and said rear wall, said U-shaped peripheral edge portion defining a forwardly opening interior passage therethrough.

16. The portable workstation according to claim 15, wherein said bottom wall includes a bottom cover hingedly secured to said peripheral edge portion and movable between a closed position overlying said interior passage and an open position disposed upwardly out of said interior passage.

17. A portable workstation, comprising:

an upright multi-sided hollow enclosure defined by a cabinet having opposed first and second side walls joined to an upright rear wall extending therebetween, said cabinet defining an interior compartment accessible through an open upright front side of said cabinet, and door means hingedly connected to one front edge of said first side wall of said cabinet by hinge means for horizontal swinging movement of said door means between open and closed positions, said door means when in said closed position overlying said cabinet and closing off said open front side thereof, said door means being swingingly positioned outwardly away from said open front side of said cabinet when disposed in said open position;

a bottom wall disposed between said first and second side walls and extending forwardly from said rear wall;

a first table top disposed within said interior compartment which defines an upward facing first work surface;

a second table top disposed within said interior compartment which defines a second upward facing work surface, said second table top being slidably supported in said cabinet by slide means to permit telescoping movement thereof between a storage position disposed within said interior compartment and a use position projecting outwardly away from said first table top when said door means is in said open position;

a first storage space being defined within said interior compartment between said first and second table tops and said bottom wall; and said second side wall comprising a fixed first side wall portion having a rear edge region joined to said upright rear wall, and a second side wall portion having hinge means on a lower edge thereof for hingedly supporting said second side wall portion vertically above said first side wall portion for vertical swinging movement of said second side wall portion between open and closed positions, said second side wall portion when in said closed position extending upwardly from said first side wall portion, said second side wall portion being swingable outwardly into said open position wherein said second side wall portion extends sidewardly to define an upward facing third work surface oriented substantially flush with respect to said first work surface, said second side wall including support means for releasably supporting said second side wall portion in said open position independent of said door means, said lower edge of said second side wall portion being movable towards said upper edge of said first side wall portion so as to be disposed closely adjacent and vertically aligned with said upper edge when in said closed position and towards said first work surface such that said third work surface is substantially flush with respect to said first work surface when in said open position, a top end of said compartment being enclosed by a top cover which is hingedly secured to said rear wall and is swingable from an open position to a closed position overlying said top end, a top support member extending between said top cover and said first side wall to releasably support said top cover in said open position.

18. The portable workstation, comprising:

an upright multi-sided hollow enclosure defined by a cabinet having opposed first and second side walls joined to an upright rear wall extending therebetween, said cabinet defining an interior compartment accessible through an open upright front side of said cabinet, and door means for selectively opening and closing said open upright front side, said door means comprising at least one door having opposite first and second side edge sections, said first edge section being hingedly connected to a front edge of said first side wall of said cabinet by hinge means for horizontal swinging movement of said door between open and closed positions, said door when in said closed position extending between said first and second side walls and having said second side edge section disposed closely adjacent said second side wall so as to close off said open front side, said second side edge section of said door being swingingly positioned outwardly away from said open front side of said cabinet when disposed in said open position;

a first table top secured to said enclosure and disposed within said interior compartment which defines an upward facing first work surface, said first side wall, said rear wall and said door extending upwardly a substantial distance above said first work surface;

said second side wall comprising a fixed first side wall portion joined to said upright rear wall, and a second side wall portion having pivot means disposed proximate a side edge of said first work surface for hingedly supporting said second side wall portion vertically above said first side wall portion for vertical swinging movement of said second side wall portion between open and closed positions, said second side wall portion being swingable outwardly into said open position wherein said second side wall portion extends horizontally sidewardly to define an upward facing second work surface, said second side wall including support means for releasably supporting said second side wall portion in said open position independent of said door, said second side wall portion when in said closed position being upwardly aligned with said first side wall portion;

a first storage space being defined between a front edge of said first table top and an interior surface of said door, and a second storage space being defined within said interior compartment below said first table top; and a chair having a seat portion and a backrest extending upwardly from said seat portion, said seat portion being storable within said second storage space and said backrest being storable within said first storage space when said seat portion is stored within said second storage space.

19. A portable workstation according to claim 18, wherein a freestanding table is removably stored within said second storage space.

20. A portable workstation according to claim 19, wherein said freestanding table includes downwardly depending spaced apart support legs, said seat portion being stored within said second storage space below a bottom surface of said freestanding table between said support legs.

21. The portable workstation according to claim 18, wherein an upward facing bottom wall is secured to said cabinet proximate a bottom end thereof so as to define said second storage space between said bottom wall and said first table tops said seat portion of said chair being supported on said bottom wall when stored within said second storage space.

22. A portable workstation according to claim 18, including a second table top disposed within said interior compartment proximate said first table top which defines a third upward facing work surface, said second table top being slidably supported in said cabinet by slide means to facilitate telescoping movement thereof between a storage position disposed within said interior compartment and a use position projecting outwardly away from said first table top when said door is in said open position, a top cover being connected to the cabinet by hinge means for selectively opening and closing a top end of said interior compartment.

* * * * *

UNITED STATES PATENT AND TRADEMARK OFFICE

CERTIFICATE OF CORRECTION

PATENT NO. : 5,803,562

DATED : September 8, 1998

INVENTOR(S) : Ronna L. Jacobs et al

It is certified that error appears in the above-identified patent and that said Letters Patent is hereby corrected as shown below:

Column 10, line 9; change "edges;" to ---edges,---.
line 22; after "said" insert ---first---.
Column 15, line 1; change "The" to ---A---.
Column 16, line 14; change "A" to ---The---.
line 17; change "A" to ---The---.
line 26; change "tops" to ---top,---.
line 29; change "A" to ---The---.

Signed and Sealed this

Eighteenth Day of May, 1999

*Attest:*

Q. TODD DICKINSON

*Attesting Officer*

*Acting Commissioner of Patents and Trademarks*